US008850993B2

(12) United States Patent
Storteboom et al.

(10) Patent No.: US 8,850,993 B2
(45) Date of Patent: Oct. 7, 2014

(54) SHIPPING PLATFORM

(71) Applicant: CHEP Technology Pty Limited, Sydney (AU)

(72) Inventors: John Thomas Storteboom, Orlando, FL (US); Oivind Brockmeier, Medford, MA (US); Brandon M. D'Emidio, Orlando, FL (US); Timothy R. Proulx, Nashua, NH (US); Gregory S. Burkett, Cambridge, MA (US); Jeffrey R. Chapin, Cambridge, MA (US); Kenneth M. Brandt, Orlando, FL (US)

(73) Assignee: Chep Technology Pty Limited, Sydney NSW (AU)

( * ) Notice: Subject to any disclaimer, the term of this patent is extended or adjusted under 35 U.S.C. 154(b) by 20 days.

(21) Appl. No.: 13/716,086

(22) Filed: Dec. 15, 2012

(65) Prior Publication Data

US 2013/0175198 A1 Jul. 11, 2013

Related U.S. Application Data

(60) Provisional application No. 61/576,979, filed on Dec. 16, 2011.

(51) Int. Cl.
*B65D 19/00* (2006.01)
*B65B 45/00* (2006.01)

(52) U.S. Cl.
CPC .. *B65D 19/0002* (2013.01); *B65D 2519/00323* (2013.01); *B65B 45/00* (2013.01); *B65D 2519/00029* (2013.01); *B65D 2519/00572* (2013.01); *B65D 2519/00064* (2013.01); *B65D 19/0093* (2013.01); *B65D 2519/00348* (2013.01); *B65D 2519/00273* (2013.01); *B65D 2519/00293* (2013.01)
USPC ..... 108/51.11

(58) Field of Classification Search
CPC ..... B65D 2519/00323; B65D 2519/00293; B65D 2519/00333; B65D 2519/00273; B65D 2519/00572; B65D 2519/00298; B65D 2519/00034; B65D 19/0095; B65D 19/0004; B65D 19/0053; B65D 19/38; B65D 2519/00119; B65D 2519/00134; B65D 2519/00552; B65D 2519/008825
USPC ..... 108/51.11, 56.1, 56.3, 57.17; 206/386, 206/597; 53/461
See application file for complete search history.

(56) References Cited

U.S. PATENT DOCUMENTS

| | | | | | |
|---|---|---|---|---|---|
| 2,448,447 | A * | 8/1948 | Lau | 108/51.11 |
| 2,651,586 | A * | 9/1953 | Cooper et al. | 427/9 |
| 2,783,960 | A * | 3/1957 | Herz et al. | 108/56.1 |
| 2,923,511 | A * | 2/1960 | Americo | 108/57.1 |
| 3,005,610 | A * | 10/1961 | Arthur | 108/57.2 |
| 3,122,108 | A * | 2/1964 | Arthur | 108/57.2 |
| 3,227,107 | A * | 1/1966 | Caplan | 108/57.2 |
| 3,572,261 | A * | 3/1971 | Vasiliou | 108/56.1 |
| 4,509,432 | A * | 4/1985 | Win | 108/57.25 |
| 4,907,515 | A * | 3/1990 | Win | 108/57.25 |
| 5,158,403 | A * | 10/1992 | Moors | 108/56.3 |
| 5,487,343 | A * | 1/1996 | Phillips | 108/57.2 |
| 2007/0283857 | A1* | 12/2007 | Dong | 108/51.11 |
| 2009/0053033 | A1* | 2/2009 | Barbalho et al. | 414/802 |
| 2011/0132237 | A1* | 6/2011 | Brandt et al. | 108/51.11 |
| 2013/0174763 | A1* | 7/2013 | Storteboom et al. | 108/51.11 |

* cited by examiner

*Primary Examiner* — Janet M Wilkens
(74) *Attorney, Agent, or Firm* — Ido Tuchman

(57) ABSTRACT

A system may include structural components, and joining areas on the structural components where fasteners connect the structural components into a shipping platform. The system may also include a wrap positioned on each selected joining area of selected structural components where the fasteners connect the selected structural components together.

20 Claims, 15 Drawing Sheets

SHIPPING PLATFORM

RELATED APPLICATIONS

This application claims the benefit of co-pending U.S. Provisional Patent Application Nos. 61/576,979, filed on Dec. 16, 2011, entitled "Improved Shipping Platform", the entire subject matter of which is incorporated herein by reference in its entirety.

BACKGROUND

Shippers, manufacturers, wholesalers, retailers, and/or the like move merchandise, materials, and/or the like (e.g. load, to customers, end-users, and/or the like) on shipping platforms (e.g. pallet, containers, and/or the like). This technique of bulk shipping may reduce the cost related to moving the load when compared to non-bulk shipping methods. As a result, all parties in the distribution chain may benefit from lower shipping costs due to this bulk shipping technique.

There are a number of issues with the above described technique. One issue is that shipping platforms are exposed to a harsh operating environment. Another issue is the shipping platform may be restricted in any number of ways by regulatory and/or standardization requirements.

FIG. 1 illustrates a common form of a shipping platform that is often referred to as a pallet. In this form, the shipping platform is fabricated out of wooden structural components joined together by metal fasteners such as nails.

SUMMARY

According to one embodiment, a system may include structural components, and joining areas on the structural components where fasteners connect the structural components into a shipping platform. The system may also include a wrap positioned on each selected joining area of selected structural components where the fasteners connect the selected structural components together.

The wrap may restrict the selected joining area from expanding past a threshold. The wrap and the selected joining area may be stronger in combination than either alone.

The wrap may comprise tape, banding strap, PVC heat shrink tubing, plastic wrap, adhesive, and/or curable resins. The wrap may be applied to the selected joining area before the fasteners connect the selected structural components together. The wrap may be applied to the selected joining area after the fasteners connect the selected structural components together.

The wrap may maintain structural integrity when pierced by the fasteners. The wrap may produce little change to the overall dimensions or weight of the shipping platform.

The wrap may be applied to a plurality of selected joining areas as a single installation. The wrap may be applied around the selected joining area.

Another aspect of the embodiments is a method. The method may include connecting structural components with fasteners at joining areas into a shipping platform. The method may also include positioning a wrap on each selected joining area of selected structural components where the fasteners connect the selected structural components together.

The method may further include restricting the selected joining area from expanding past a threshold via the wrap. The method may additionally include strengthening the selected joining area via the wrap.

The method may also include applying the wrap to the selected joining area before the fasteners connect the selected structural components together. The method may further include applying the wrap to the selected joining area after the fasteners connect the selected structural components together.

The method may additionally include maintaining the wrap's structural integrity when pierced by the fasteners. The method may also include applying the wrap to a plurality of selected joining areas as a single installation. The method may further include applying the wrap around the selected joining area.

An alternative embodiment of the system may include structural components, and joining areas on the structural components where fasteners connect the structural components into a shipping platform. The system may also include a wrap positioned on each selected joining area of selected structural components where the fasteners connect the selected structural components together, the wrap restricts the selected joining area from expanding past a threshold and the wrap producing little change to the overall dimensions or weight of the shipping platform.

DETAILED DESCRIPTION

Embodiments will now be described more fully hereinafter with reference to the accompanying drawings, in which preferred embodiments are shown. Like numbers refer to like elements throughout, like numbers with letter suffixes are used to identify similar parts in a single embodiment, and letter suffix lower case n is a variable that indicates an unlimited number of similar elements.

With reference now to FIGS. 2-7, a system 10 for an improved shipping platform 12 is initially described. In one embodiment, the system 10 may include binding any of the structural components 14*a*-14*n* around the joining areas 16*a*-16*n* with a respective wrap 18*a*-18*n*.

The structural components 14*a*-14*n* comprise wood, metal, plastic, composite materials, and/or the like. The joining areas 16*a*-16*n* comprises application points for fasteners 20*a*-20*n* such as nails, screws, dowels, adhesives, and/or the like. The structural components 14*a*-14*n* are arranged into a shipping platform 12 configuration and joined together by fasteners 20*a*-20*n* in the joining areas 16*a*-16*n* as will be appreciated by those of skill in the art.

The wrap 18*a*-18*n* comprises tape, banding strap, PVC heat shrink tubing, plastic wrap, and/or the like. The wrap 18*a*-18*n* binds any of the structural components 14*a*-14*n* around and/or near the joining areas 16*a*-16*n*. The wrap 18*a*-18*n* is applied to the structural components 14*a*-14*n* either before or after the fasteners 20*a*-20*n* are applied to the joining areas 16*a*-16*n*.

The wrap 18*a*-18*n* may help to keep the structural components 14*a*-14*n* from splitting during fastener 20*a*-20*n* insertion. The combination, e.g. composite, of the structural components 14*a*-14*n* and the wrap 18*a*-18*n* may also increase the durability of the joint in the joining areas 16*a*-16*n* when compared to a shipping platform 12 without such a combination in its joining area.

For example, a shipping platform 12 is exposed to many different forces that strain joining areas 16*a*-16*n* such as vibrations from the shipping process, e.g. road vibrations, ship vibrations, and/or the like. Another force that a shipping platform 12 is commonly exposed to is impacts with handling equipment such as forklifts, pallet jacks, loading areas, and/or the like. These forces, as well as others, create issues for the integrity of the shipping platform 12 due to the strains placed upon the joining areas 16*a*-16*n*.

The system 10 addresses potential weaknesses in the joining areas 16*a*-16*n* of shipping platforms 12 while also keeping the shipping platforms within standardization requirements. In other words, system 10 changes the dimensions of a shipping platform 12 very little. As a result, system 10 can be deployed with little impact to the overall system in which the shipping platforms 12 flow. In addition, the system 10 also provides a retrofit option that can be deployed to improve an existing pool of shipping platforms 12.

Figure 1:
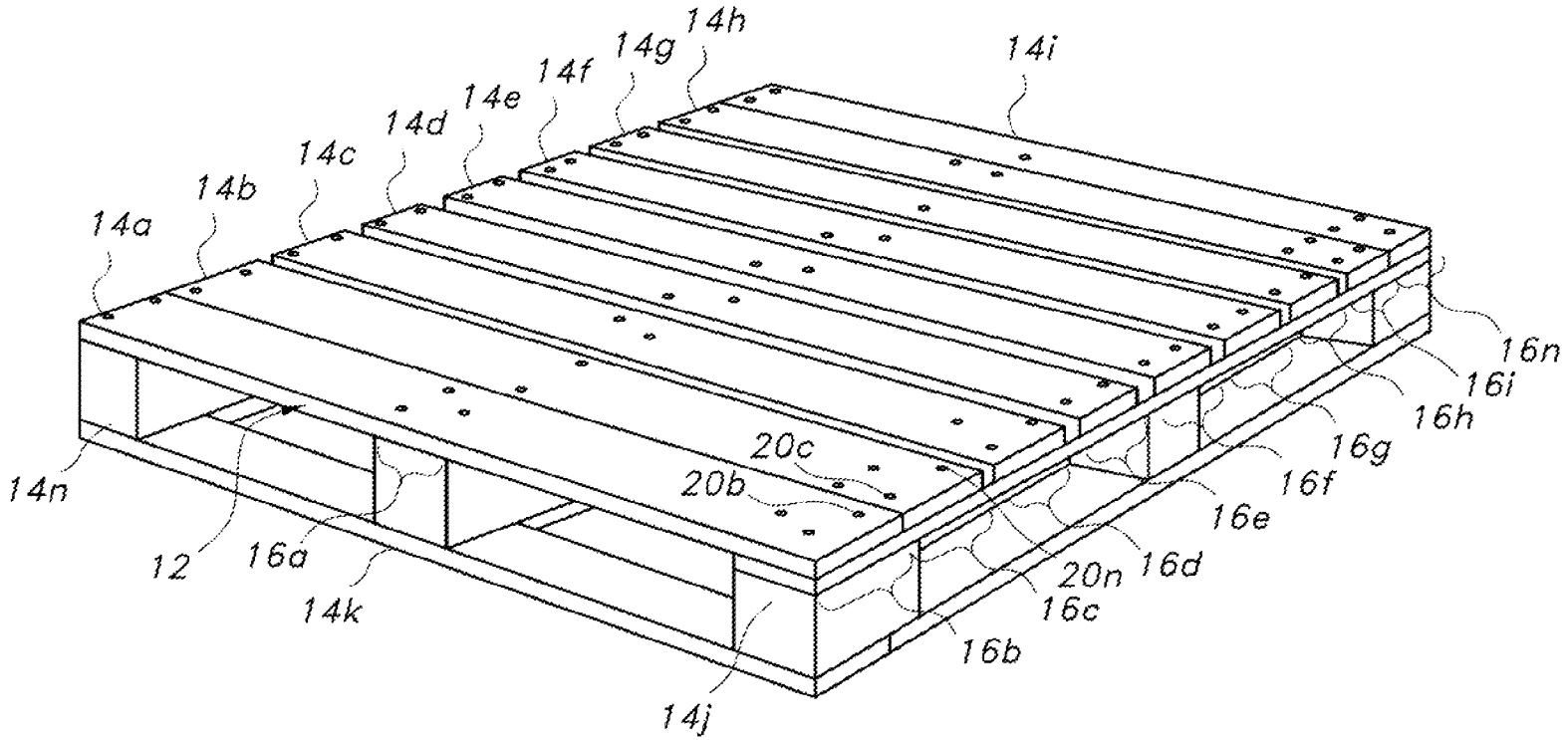
FIG. 1 (PRIOR ART)
FIG. 1 illustrates a prior art shipping platform.
Figure 2:
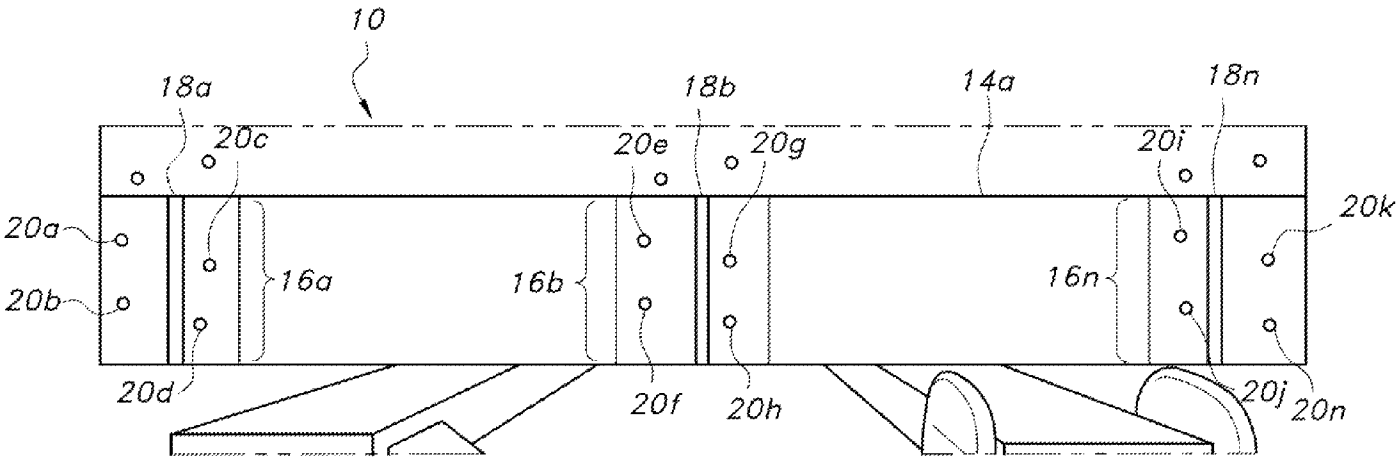
FIG. 2 illustrates a wrap applied to a structural component of a shipping platform in accordance with the embodiments.
Figure 3:
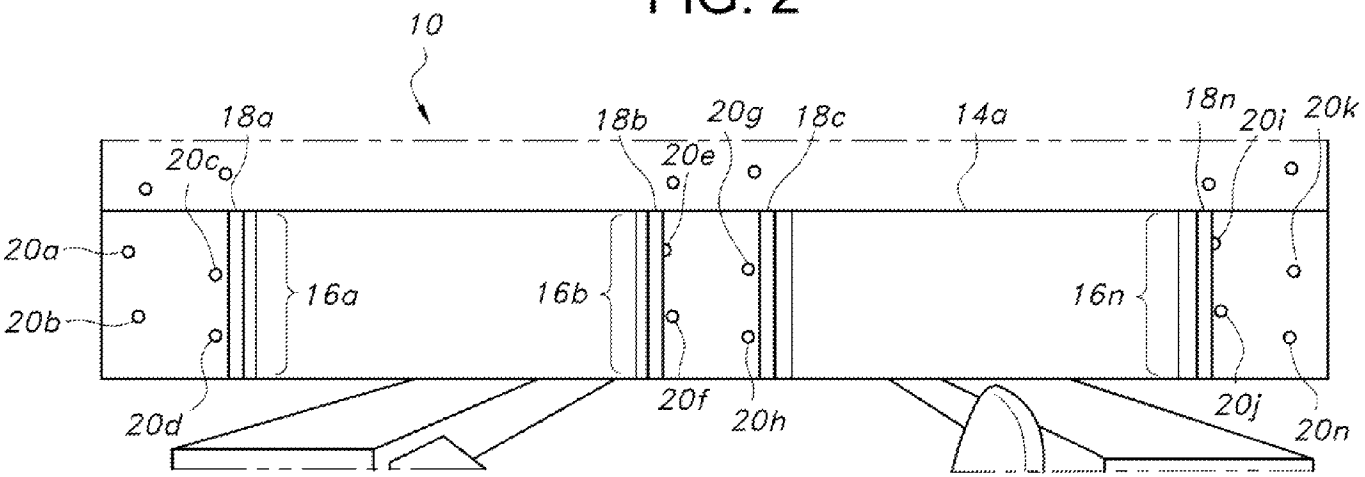
FIG. 3 illustrates an alternative wrap applied to a structural component of a shipping platform in accordance with the embodiments.
Figure 4:
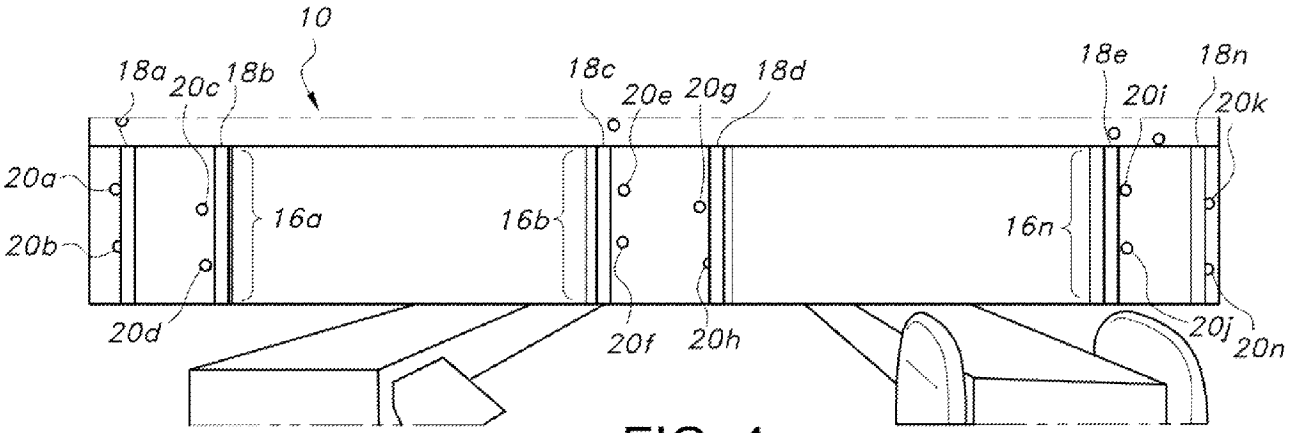
FIG. 4 illustrates an alternative wrap applied to a structural component of a shipping platform in accordance with the embodiments.
Figure 5:
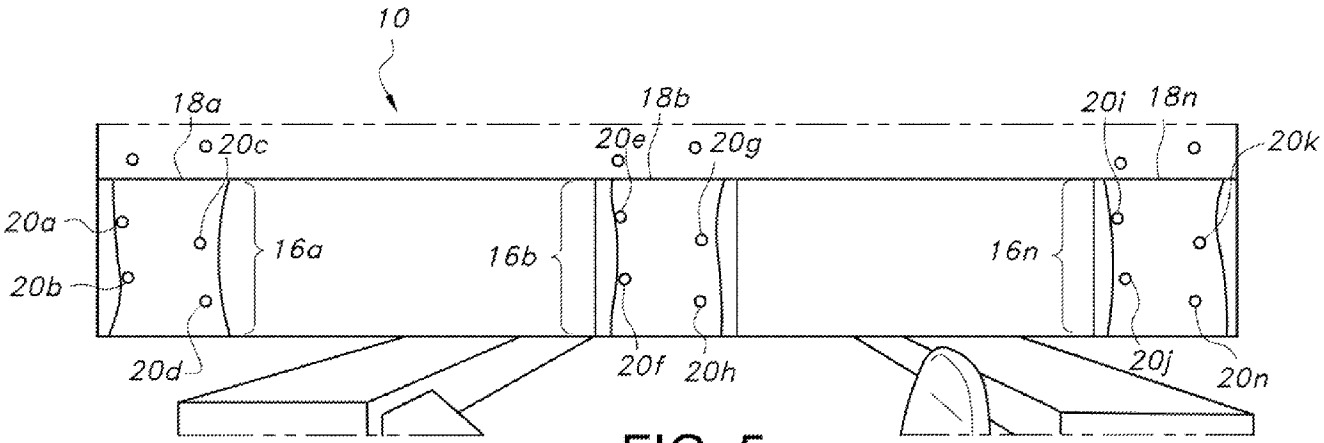
FIG. 5 illustrates an alternative wrap applied to a structural component of a shipping platform in accordance with the embodiments.
Figure 6:
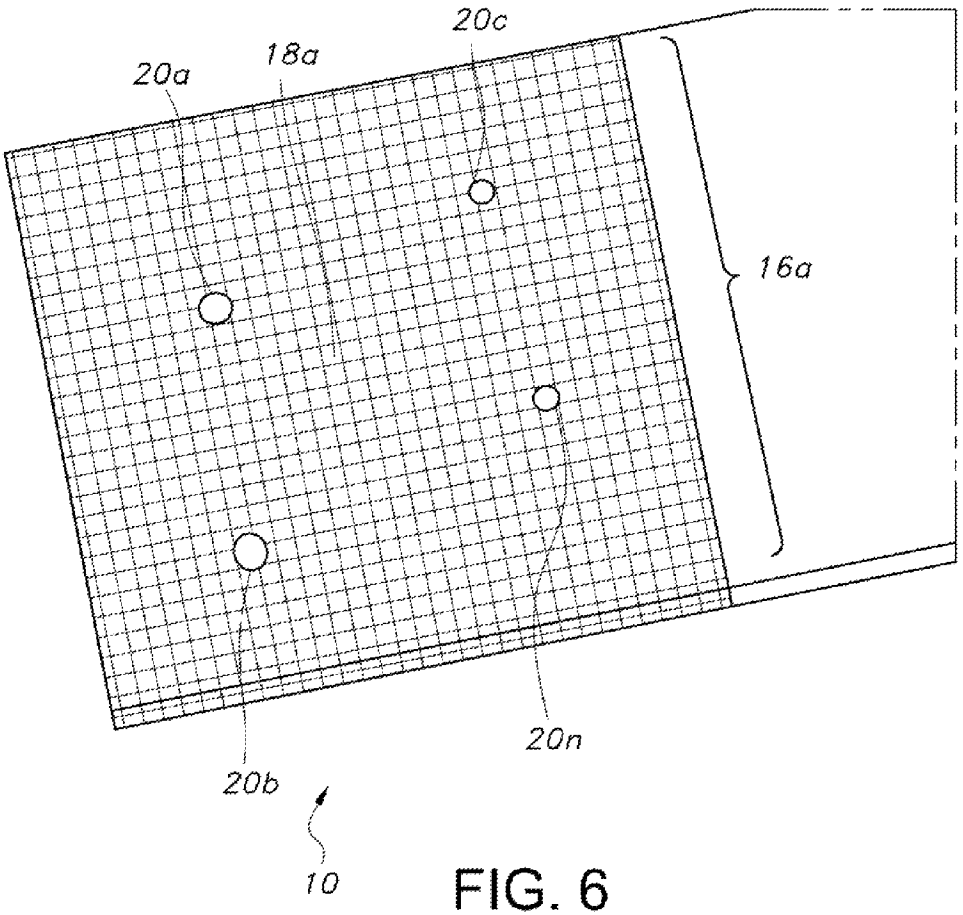
FIG. 6 illustrates an alternative wrap applied to a structural component of a shipping platform in accordance with the embodiments.
Figure 7:
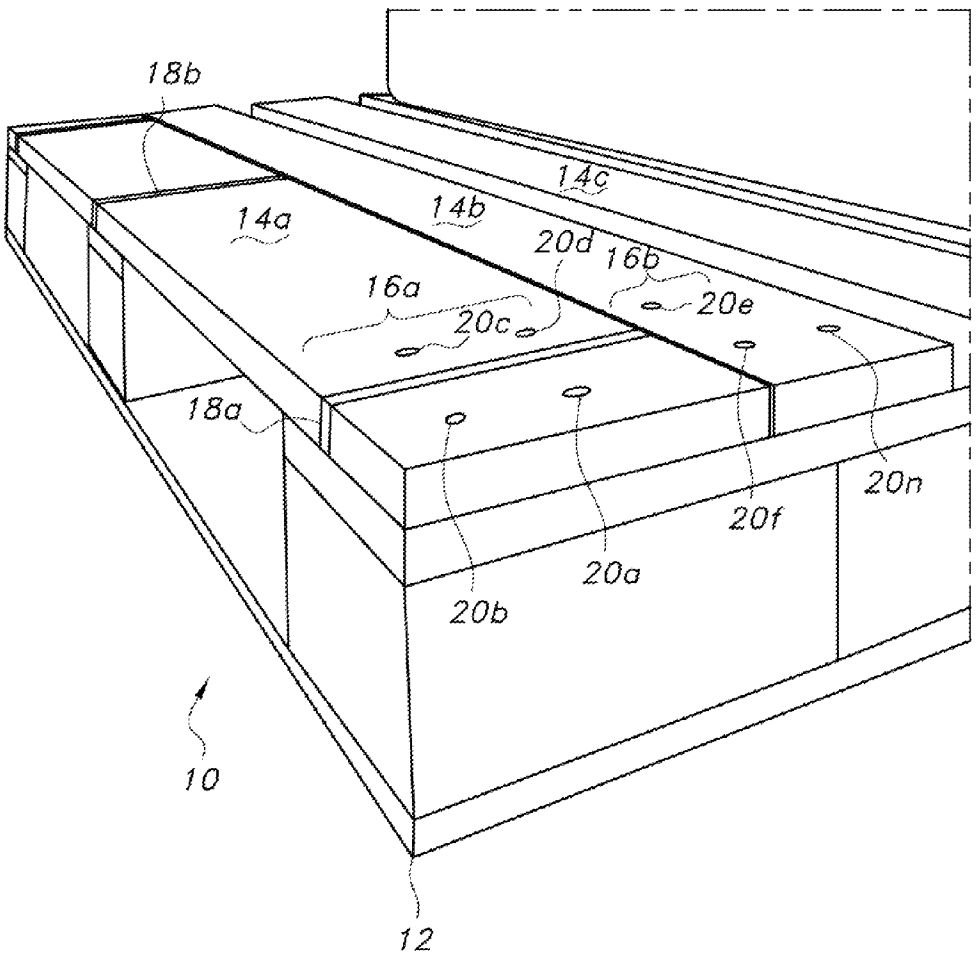
FIG. 7 illustrates an alternate view of the embodiment in FIG. 2.
Figure 8:
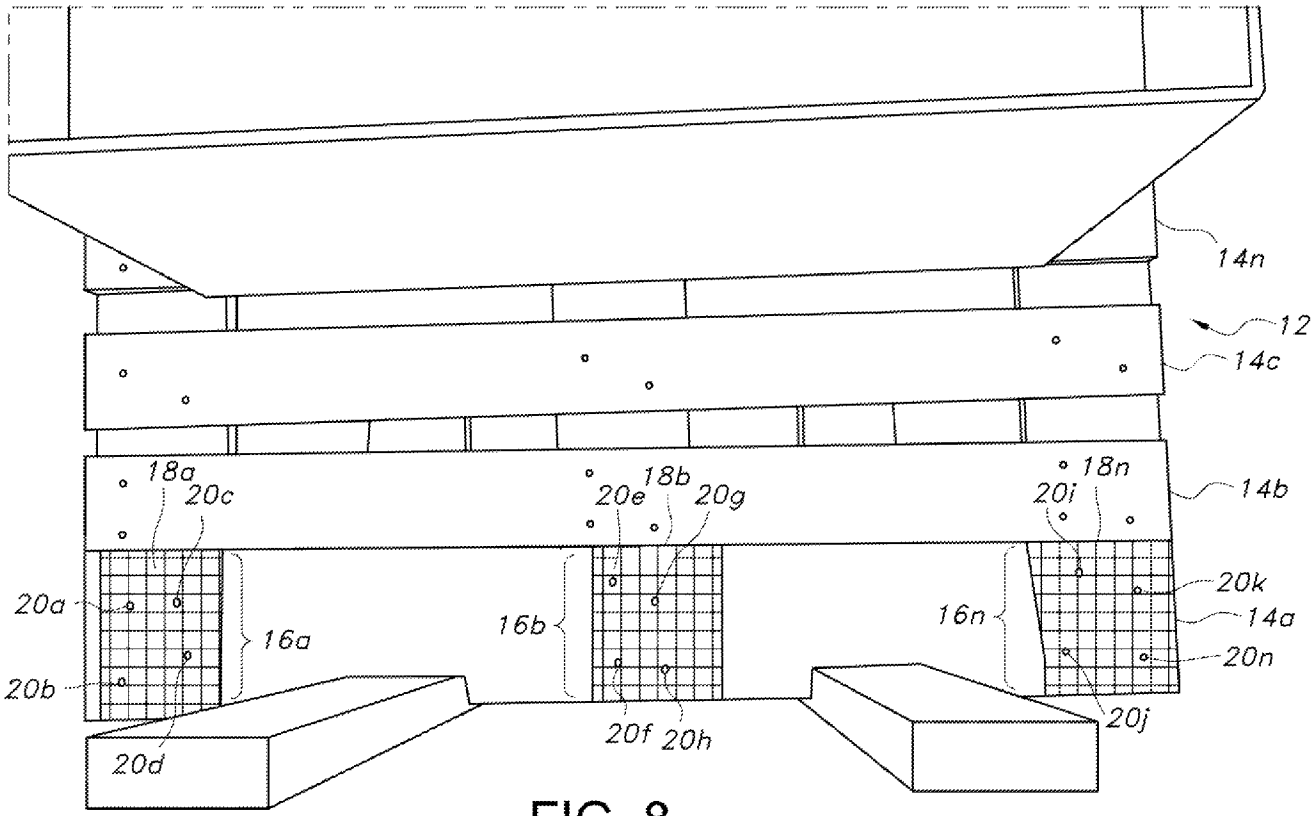
FIG. 8 illustrates the embodiment of FIG. 6 being exposed to a deformation test.
Figure 9:
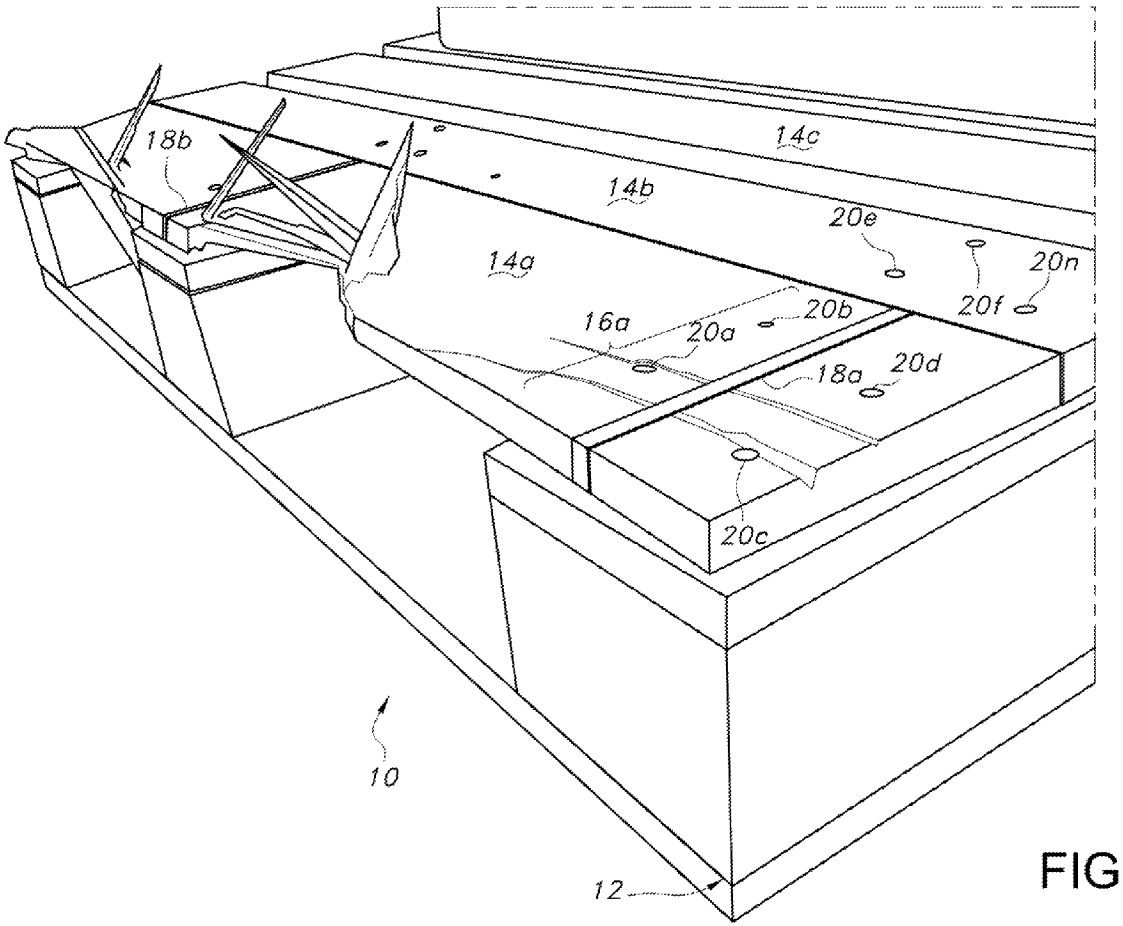
FIG. 9 illustrates the embodiment of FIG. 2 post deformation test.

With additional reference to FIGS. 8 and 9 in which the utility of system 10 is illustrated. As shown, a load was applied to structural components 14*a*-14*n* to the point of failure of the structural components. As is evidenced by the figures, wraps 18*a*-18*n* improve the structural integrity of the structural members 18*a*-18*n* past their original failure points.

In one embodiment, the system 10 includes structural components 14*a*-14*n*, and joining areas 16*a*-16*n* on the structural components where fasteners 20*a*-20*n* connect the structural components into a shipping platform 12. The system 10 also includes a wrap 18*a*-18*n* positioned on each selected joining area 16*a*-16*n* of selected structural components 14*a*-14*n* where the fasteners 20*a*-20*n* connect the selected structural components together. In other words, the selected joining areas 16*a*-16*n* are a portion of the total number of joining areas that are chosen for an engineering reason, e.g. history of failure, history of repair, etc.

In one embodiment, the wrap 18*a*-18*n* restricts the selected joining area 16*a*-16*n* from expanding past a threshold. In another embodiment, the wrap 18*a*-18*n* and the selected joining area 16*a*-16*n* is stronger in combination than either alone, e.g. the wrap or selected joining area. Stated another way, the composite of the wrap 18*a*-18*n* and the selected joining area 16*a*-16*n* are stronger than the wrap or selected joining area.

In one embodiment, the wrap 18*a*-18*n* comprises tape, banding strap, PVC heat shrink tubing, plastic wrap, adhesive, and/or curable resins. Curable resins include polyester resin, epoxy resin, and/or the like and may include fiberglass mat, divinycell foam, and/or the like. In another embodiment, the wrap 18*a*-18*n* is applied to the selected joining area 16*a*-16*n* before the fasteners 20*a*-20*n* connect the selected structural components 14*a*-14*n* together. In another embodiment, the wrap 18*a*-18*n* is applied to the selected joining area 16*a*-16*n* after the fasteners 20*a*-20*n* connect the selected structural components 14*a*-14*n* together.

In one embodiment, the wrap 18*a*-18*n* maintains structural integrity when pierced by the fasteners 20*a*-20*n*. In another embodiment, the wrap 18*a*-18*n* produces little change to the overall dimensions or weight of the shipping platform 12.

In one embodiment, the wrap 18*a*-18*n* is applied to a plurality of selected joining areas 16*a*-16*n* as a single installation. In another embodiment, the wrap 18*a*-18*n* is applied around the selected joining area 16*a*-16*n*.

Figure 10:
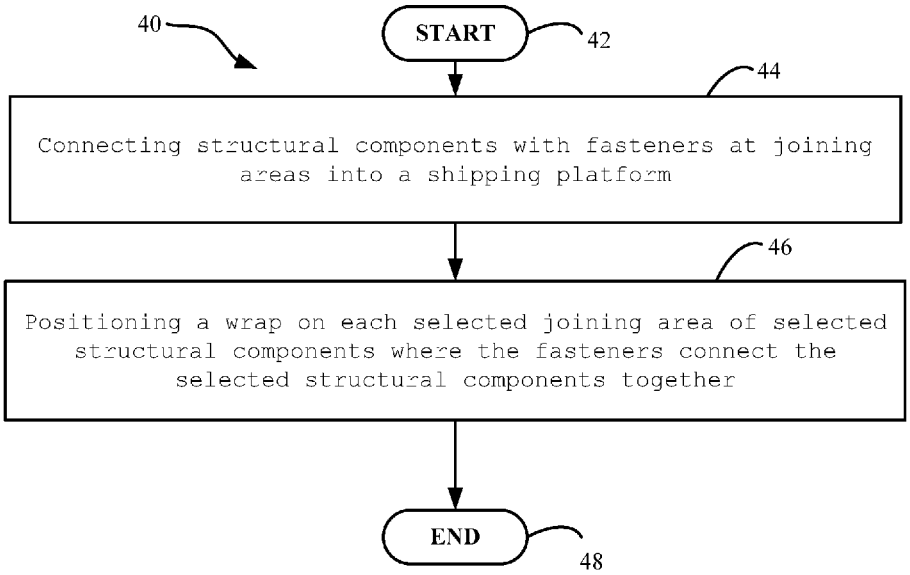
FIG. 10 is a flowchart illustrating method aspects according to embodiments.

Another aspect of the embodiments is a method, which is now described with reference to flowchart 40 of FIG. 10. The method begins at Block 42 and may include connecting structural components with fasteners at joining areas into a shipping platform at Block 44. The method may also include positioning a wrap on each selected joining area of selected structural components where the fasteners connect the selected structural components together at Block 46. The method ends at Block 48.

Figure 11:
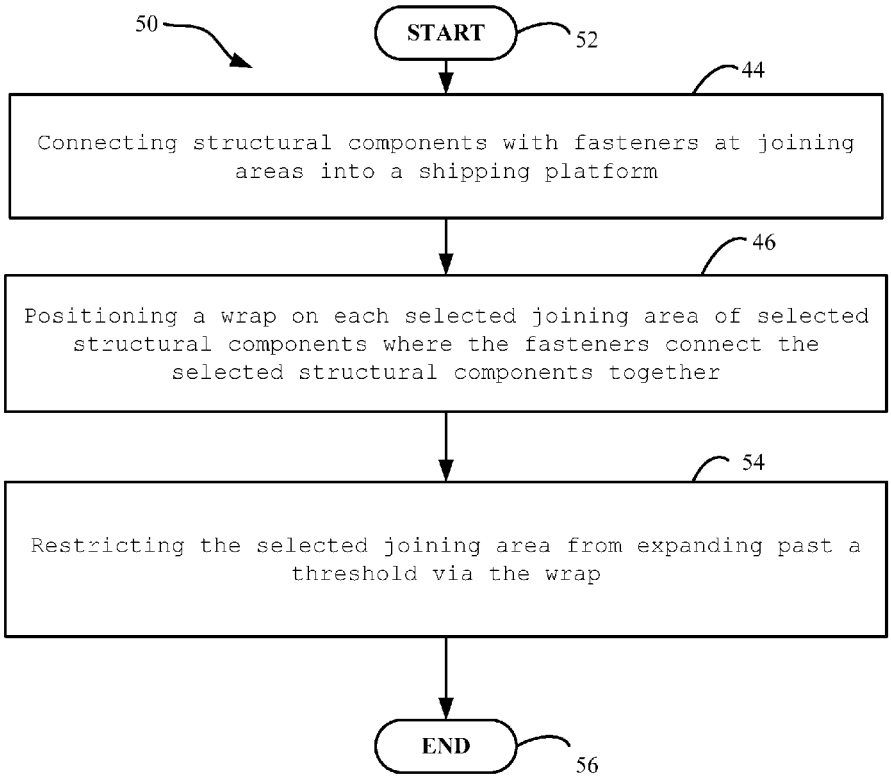
FIG. 11 is a flowchart illustrating method aspects according to the method of FIG. 10.

In another method embodiment, which is now described with reference to flowchart 50 of FIG. 11, the method begins at Block 52. The method may include the steps of FIG. 10 at Blocks 44 and 46. The method may additionally include restricting the selected joining area from expanding past a threshold via the wrap at Block 54. The method ends at Block 56.

Figure 12:
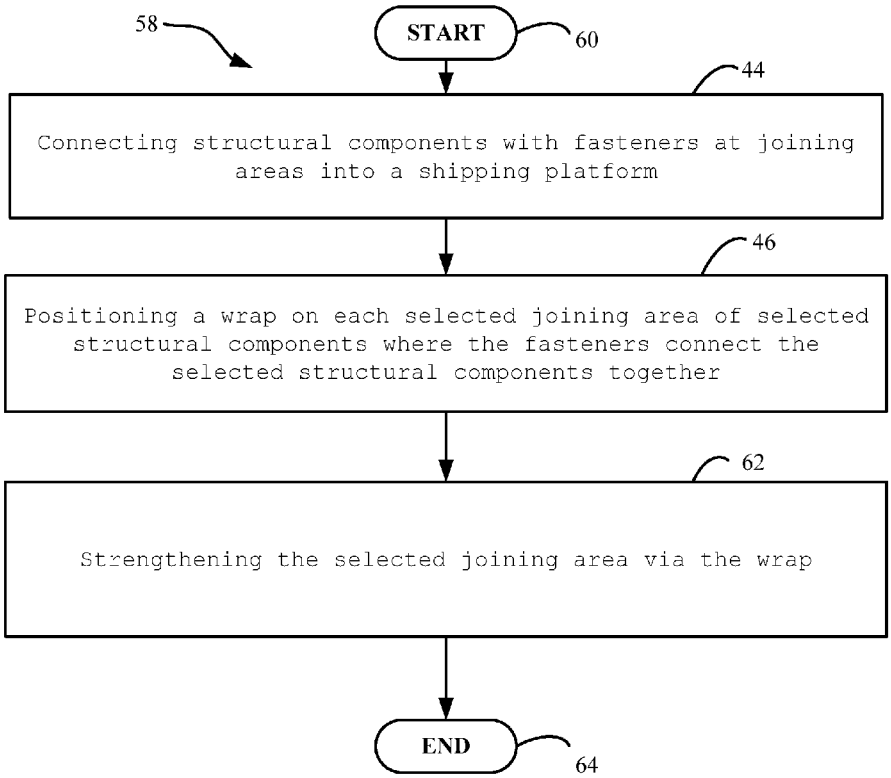
FIG. 12 is a flowchart illustrating method aspects according to the method of FIG. 10.

In another method embodiment, which is now described with reference to flowchart 58 of FIG. 12, the method begins at Block 60. The method may include the steps of FIG. 10 at Blocks 44 and 46. The method may further include strengthening the selected joining area via the wrap at Block 62. The method ends at Block 64.

Figure 13:
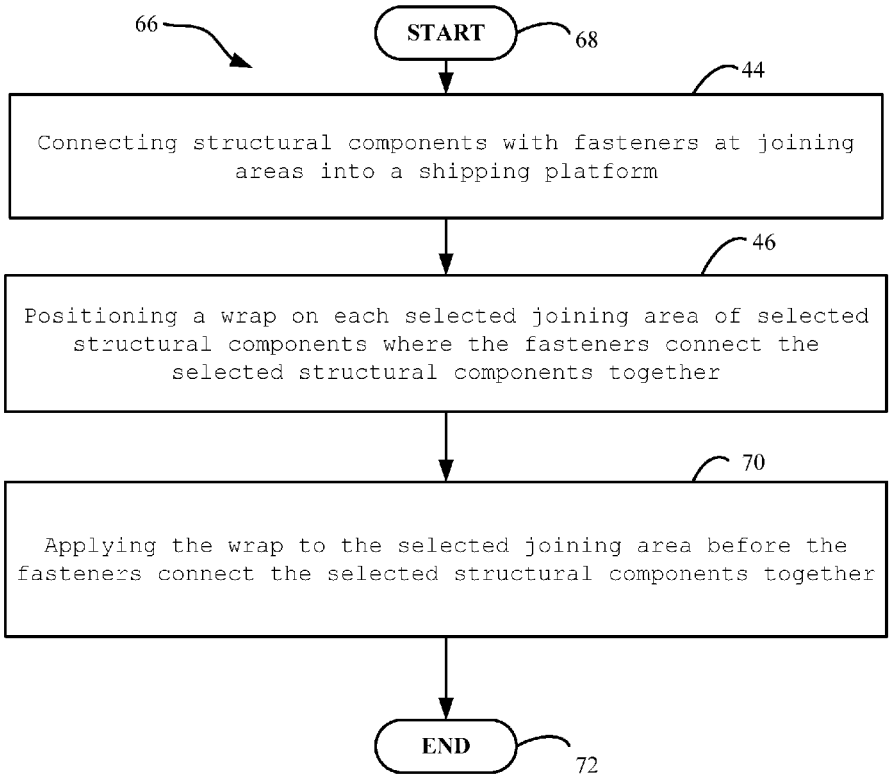
FIG. 13 is a flowchart illustrating method aspects according to the method of FIG. 10.

In another method embodiment, which is now described with reference to flowchart 66 of FIG. 13, the method begins at Block 68. The method may include the steps of FIG. 10 at Blocks 44 and 46. The method may further include applying the wrap to the selected joining area before the fasteners connect the selected structural components together at Block 70. The method ends at Block 72.

Figure 14:
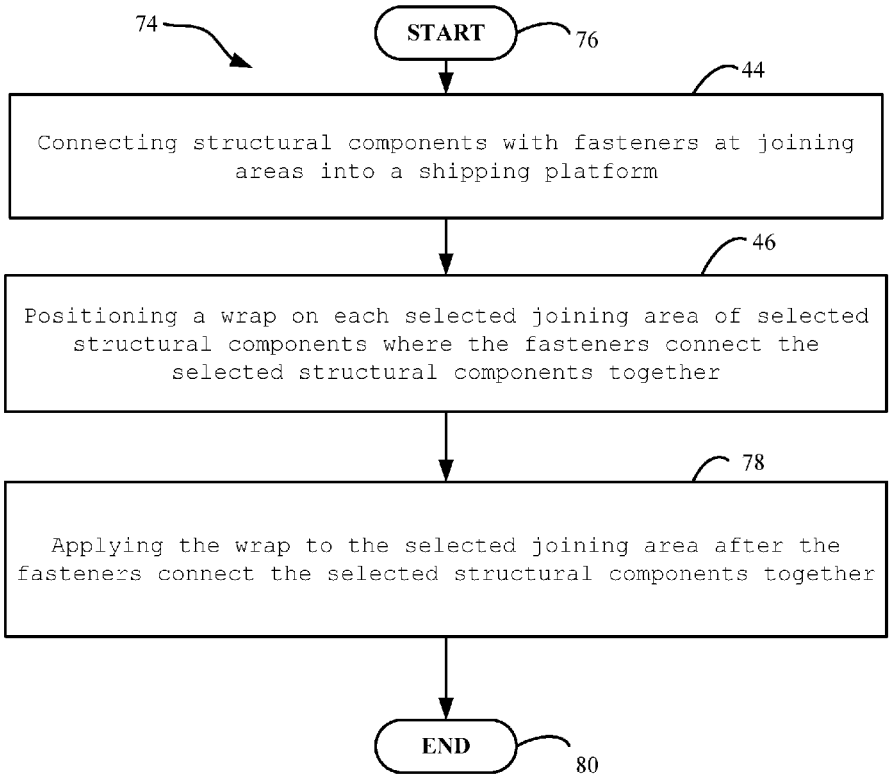
FIG. 14 is a flowchart illustrating method aspects according to the method of FIG. 10.

In another method embodiment, which is now described with reference to flowchart 74 of FIG. 14, the method begins at Block 76. The method may include the steps of FIG. 10 at Blocks 44 and 46. The method may additionally include applying the wrap to the selected joining area after the fasteners connect the selected structural components together at Block 78. The method ends at Block 80.

Figure 15:
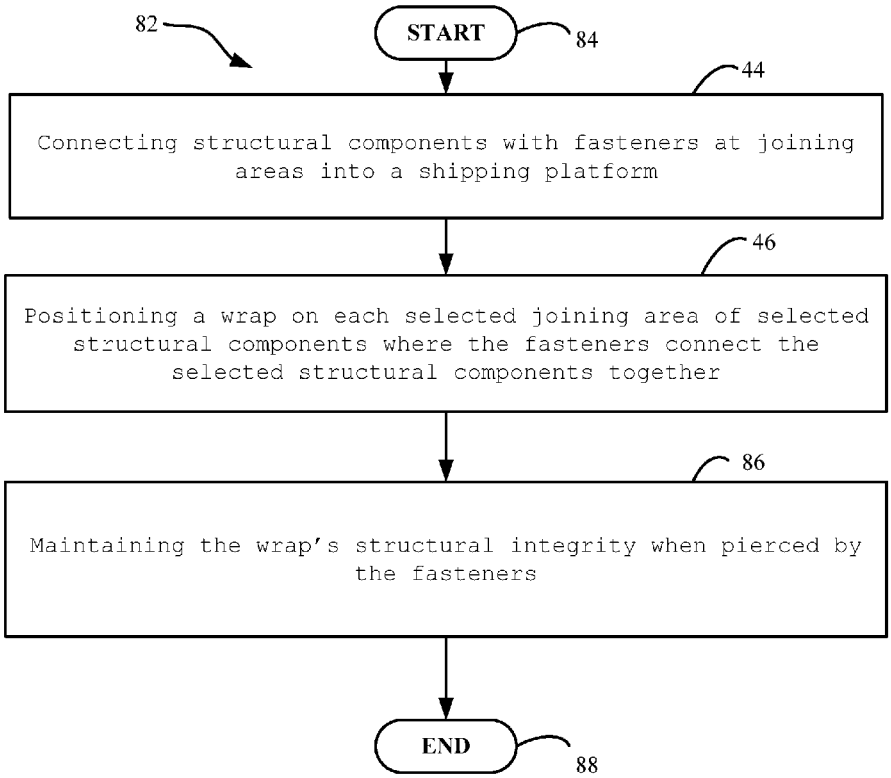
FIG. 15 is a flowchart illustrating method aspects according to the method of FIG. 10.

In another method embodiment, which is now described with reference to flowchart 82 of FIG. 15, the method begins at Block 84. The method may include the steps of FIG. 10 at Blocks 44 and 46. The method may additionally include maintaining the wrap's structural integrity when pierced by the fasteners at Block 86. The method ends at Block 88.

Figure 16:
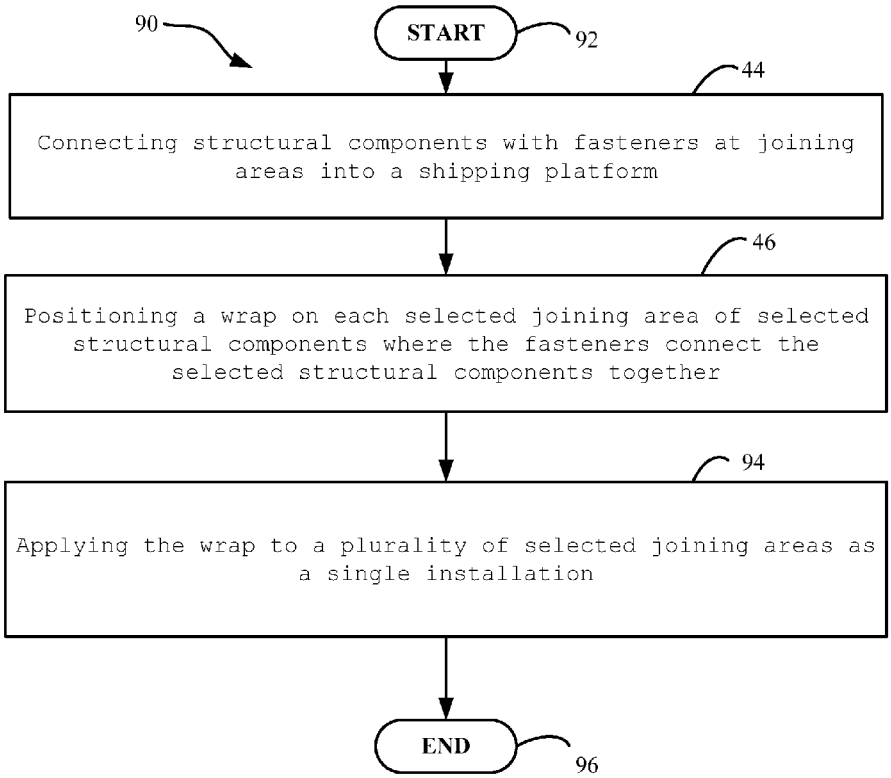
FIG. 16 is a flowchart illustrating method aspects according to the method of FIG. 10.

In another method embodiment, which is now described with reference to flowchart 90 of FIG. 16, the method begins at Block 92. The method may include the steps of FIG. 10 at Blocks 44 and 46. The method may additionally include applying the wrap to a plurality of selected joining areas as a single installation at Block 94. The method ends at Block 96.

Figure 17:
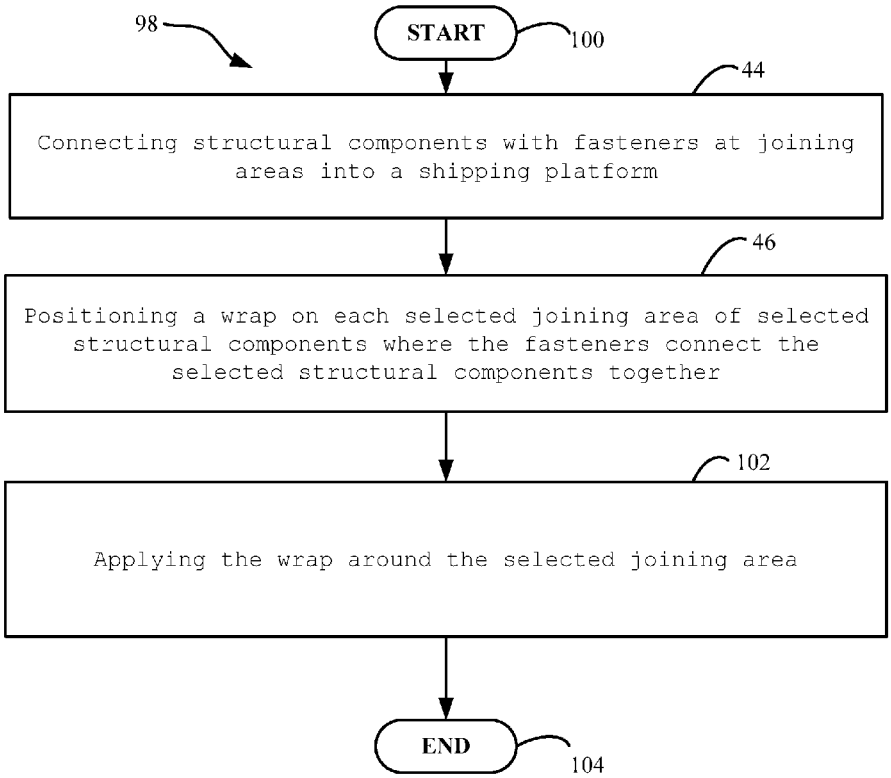
FIG. 17 is a flowchart illustrating method aspects according to the method of FIG. 10.

In another method embodiment, which is now described with reference to flowchart 98 of FIG. 17, the method begins at Block 100. The method may include the steps of FIG. 10 at Blocks 44 and 46. The method may additionally include applying the wrap around the selected joining area at Block 102. The method ends at Block 104.

An alternative embodiment of the system 10 includes structural components 14*a*-14*n*, and joining areas 16*a*-16*n* on the structural components where fasteners 20*a*-20*n* connect the structural components into a shipping platform 12. The system 10 also includes a wrap 18*a*-18*n* positioned on each selected joining area 16*a*-16*n* of selected structural components 14*a*-14*n* where the fasteners connect the selected structural components together, the wrap restricts the selected joining area from expanding past a threshold, and the wrap producing little change to the overall dimensions or weight of the shipping platform 12.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiment was chosen and described in order to best explain the principles of the embodiment and the practical application, and to enable others of ordinary skill in the art to understand the various embodiments with various modifications as are suited to the particular use contemplated.

It should be noted that in some alternative implementations, the functions noted in a flowchart block may occur out of the order noted in the figures. For instance, two blocks shown in succession may, in fact, be executed substantially concurrently, or the blocks may sometimes be executed in the reverse order, depending upon the functionality involved because the flow diagrams depicted herein are just examples. There may be many variations to these diagrams or the steps (or operations) described therein without departing from the spirit of the embodiments. For example, the steps may be performed concurrently and/or in a different order, or steps may be added, deleted, and/or modified. All of these variations are considered a part of the claimed embodiments.

While the preferred embodiment have been described, it will be understood that those skilled in the art, both now and in the future, may make various improvements and enhancements which fall within the scope of the claims which follow. These claims should be construed to maintain the proper protection for the embodiments first described.

What is claimed is:

1. A shipping platform system comprising:

structural components including at least one load-receiving board having four sides;

joining areas on the structural components where fasteners connect the structural components into a shipping platform; and a wrap positioned on each selected joining area of selected structural components where the fasteners connect the selected structural components together, the wrap contacting the load-receiving board on its four sides.

2. The system of claim 1 wherein the wrap restricts the selected joining area from expanding past a threshold.

3. The system of claim 1 wherein the wrap and the selected joining area are stronger in combination than either alone.

4. The system of claim 1 wherein the wrap comprises at least one of tape, banding strap, PVC heat shrink tubing, plastic wrap, adhesive, and curable resins.

5. The system of claim 1 wherein the wrap is applied to the selected joining area before the fasteners connect the selected structural components together.

6. The system of claim 1 wherein the wrap is applied to the selected joining area after the fasteners connect the selected structural components together.

7. The system of claim 1 wherein the wrap maintains structural integrity when pierced by the fasteners.

8. The system of claim 1 wherein the wrap produces little change to the overall dimensions or weight of the shipping platform.

9. The system of claim 1 wherein the wrap is applied to the selected joining area as a single installation.

10. The system of claim 1 wherein the wrap is applied around the selected joining area.

11. A method for constructing a shipping pallet, the method comprising:

connecting structural components with fasteners at joining areas into a shipping platform, the structural components including at least one load-receiving board having four sides; and positioning a wrap on each selected joining area of selected structural components where the fasteners connect the selected structural components together, the wrap contacting the load-receiving board on its four sides.

12. The method of claim 11 further comprising restricting the selected joining area from expanding past a threshold via the wrap.

13. The method of claim 11 further comprising strengthening the selected joining area via the wrap.

14. The method of claim 11 further comprising applying the wrap to the selected joining area before the fasteners connect the selected structural components together.

15. The method of claim 11 further comprising applying the wrap to the selected joining area after the fasteners connect the selected structural components together.

16. The method of claim 11 further comprising maintaining the wrap's structural integrity when pierced by the fasteners.

17. The method of claim 11 further comprising applying the wrap to a plurality of selected joining areas as a single installation.

18. The method of claim 11 further comprising applying the wrap around the selected joining area.

19. A system comprising:

structural components including at least one load-receiving board having four sides;

joining areas on the structural components where fasteners connect the structural components into a shipping platform; and a wrap positioned on each selected joining areas of selected structural components where the fasteners connect the selected structural components together, the wrap contacting the load-receiving board on its four sides, the wrap restricts the selected joining area from expanding past a threshold and the wrap producing little change to the overall dimensions or weight of the shipping platform.

20. The system of claim 19 wherein the wrap comprises at least one of tape, banding strap, PVC heat shrink tubing, plastic wrap, adhesive, and curable resins.

* * * * *